US010301961B2

(12) United States Patent
Davis et al.

(10) Patent No.: US 10,301,961 B2
(45) Date of Patent: May 28, 2019

(54) GAS TURBINE ENGINE RAPID RESPONSE CLEARANCE CONTROL SYSTEM

(71) Applicant: United Technologies Corporation, Hartford, CT (US)

(72) Inventors: Timothy M. Davis, Kennebunk, ME (US); Brian Duguay, Berwick, ME (US)

(73) Assignee: United Technologies Corporation, Farmington, CT (US)

( * ) Notice: Subject to any disclaimer, the term of this patent is extended or adjusted under 35 U.S.C. 154(b) by 344 days.

(21) Appl. No.: 14/913,785

(22) PCT Filed: Jul. 23, 2014

(86) PCT No.: PCT/US2014/047836
§ 371 (c)(1),
(2) Date: Feb. 23, 2016

(87) PCT Pub. No.: WO2015/069328
PCT Pub. Date: May 14, 2015

(65) Prior Publication Data

US 2016/0356170 A1 Dec. 8, 2016

Related U.S. Application Data

(60) Provisional application No. 61/883,572, filed on Sep. 27, 2013.

(51) Int. Cl.
*F01D 11/08* (2006.01)
*F01D 11/22* (2006.01)
(Continued)

(52) U.S. Cl.
CPC ..... *F01D 11/22* (2013.01); *F01D 11/14* (2013.01); *F04D 29/164* (2013.01); *F01D 11/08* (2013.01);
(Continued)

(58) Field of Classification Search
CPC . F01D 9/04; F01D 11/08; F01D 11/14; F01D 11/18; F01D 11/20; F01D 11/22;
(Continued)

(56) References Cited

U.S. PATENT DOCUMENTS 5,054,997 A 10/1991 Corsmeier et al.
5,362,202 A * 11/1994 Derouet ..... F01D 11/22 415/148

(Continued)

OTHER PUBLICATIONS

EPO Official Letter dated Nov. 23, 2018 for Application No. 14860381.4.

*Primary Examiner* — Carlos A Rivera
*Assistant Examiner* — Sang K Kim
(74) *Attorney, Agent, or Firm* — O'Shea Getz P.C.

(57) ABSTRACT

An active clearance control system of a gas turbine engine includes a multiple of blade outer air seal assemblies and a sync ring with a multiple of graduation sets. Each of the graduation sets is associated with one of the multiple of blade outer air seal assemblies. An active clearance control system of a gas turbine engine includes a sync ring with a multiple of graduation sets. Each of the graduation sets includes a multiple of graduations to define an associated radial position for each of a respective multiple of blade outer air seal assemblies.

10 Claims, 7 Drawing Sheets

(51) Int. Cl.
*F01D 11/14* (2006.01)
*F04D 29/16* (2006.01)

(52) U.S. Cl.
CPC ..... *F05D 2220/32* (2013.01); *F05D 2260/50* (2013.01); *F05D 2270/60* (2013.01)

(58) Field of Classification Search
CPC .... F01D 25/24; F04D 29/164; F05D 2220/32; F05D 2240/125; F05D 2260/50; F05D 2270/60
See application file for complete search history.

(56) References Cited

U.S. PATENT DOCUMENTS

| | | | | |
|---|---|---|---|---|
| 7,625,169 | B2 * | 12/2009 | Manzoori | F01D 11/22 415/14 |
| 8,240,986 | B1 | 8/2012 | Ebert | |
| 8,256,228 | B2 * | 9/2012 | O'Leary | F01D 11/22 415/116 |
| 8,534,996 | B1 | 9/2013 | Pankey et al. | |
| 9,028,205 | B2 * | 5/2015 | Harris | F02C 9/16 415/173.1 |
| 9,057,281 | B2 * | 6/2015 | Benkler | F01D 11/22 |
| 9,228,447 | B2 * | 1/2016 | McCaffrey | F01D 11/22 |
| 9,587,507 | B2 * | 3/2017 | Ottow | F04D 29/4206 |
| 2009/0266082 | A1 | 10/2009 | O'Leary | |
| 2009/0297330 | A1 | 12/2009 | Razzell et al. | |
| 2010/0313404 | A1 | 12/2010 | Bates | |

* cited by examiner

GAS TURBINE ENGINE RAPID RESPONSE CLEARANCE CONTROL SYSTEM

CROSS-REFERENCE TO RELATED APPLICATION

This application claims priority to PCT Patent Application No. PCT/US2014/047836 filed Jul. 23, 2014, which claims priority to U.S. Patent Appln. Ser. No. 61/883,572 filed Sep. 27, 2013, each of which is hereby incorporated herein by reference in its entirety.

STATEMENT REGARDING FEDERALLY SPONSORED RESEARCH OR DEVELOPMENT

This disclosure was made with Government support under FA8650-09-D-2923 0021 awarded by the United States Air Force. The Government may have certain rights in this disclosure.

BACKGROUND

The present disclosure relates to a gas turbine engine and, more particularly, to a blade tip rapid response active clearance control (RRACC) system therefor.

Gas turbine engines, such as those that power modern commercial and military aircraft, generally include a compressor to pressurize an airflow, a combustor to burn a hydrocarbon fuel in the presence of the pressurized air, and a turbine to extract energy from the resultant combustion gases. The compressor and turbine sections include rotatable blade and stationary vane arrays. Within an engine case structure, radial outermost tips of each blade array are positioned in close proximity to a shroud assembly. Blade Outer Air Seals (BOAS) supported by the shroud assembly are located adjacent the blade tips such that a radial tip clearance is defined therebetween.

When in operation, the thermal environment in the engine varies and may cause thermal expansion and contraction such that radial tip clearance varies. The radial tip clearance is typically designed so that the blade tips do not rub against the Blade Outer Air Seal (BOAS) under high power operations when the blade disk and blades expand as a result of thermal expansion and centrifugal loads. When engine power is reduced, the radial tip clearance increases. The leakage of core air between the turbine blade tips and the BOAS has a negative effect on engine performance/efficiency, fuel burn, and component life. Minimization of this radial tip clearance may be especially complex in a military application due to multiple and rapid throttle excursions. A military engine throttle excursion such as a sudden/snap reaccelerate or hot reburst results in extreme closedown of the radial tip clearance. Conversely, the close down is much less in a cruise condition at which the engine spends the vast majority of its serviceable life.

Due to the extreme closedowns associated with sudden throttle excursions, the turbine is designed to operate with relatively large tip clearance at the high-time steady state cruise conditions which effects overall engine performance/efficiency.

SUMMARY

An active clearance control system of a gas turbine engine, according to one disclosed non-limiting embodiment of the present disclosure, includes a multiple of blade outer air seal assemblies and a sync ring with a multiple of graduation sets. Each of the graduation sets is associated with one of the multiple of blade outer air seal assemblies.

In a further embodiment of the present disclosure, each of the multiple of graduation sets includes a radially inner graduation and a radially outer graduation.

In a further embodiment of any of the foregoing embodiments of the present disclosure, an intermediate graduation is included radially between the radially inner graduation and the radially outer graduation.

In a further embodiment of any of the foregoing embodiments of the present disclosure, each of the multiple of blade outer air seal assemblies includes a blade outer air seal and a follow rod that extends therefrom.

In a further embodiment of any of the foregoing embodiments of the present disclosure, each of the multiple of follower rods terminates in a follow transverse to the follower rod.

In a further embodiment of any of the foregoing embodiments of the present disclosure, each of the followers supports an insert.

In a further embodiment of any of the foregoing embodiments of the present disclosure, each insert is manufactured of a material different than the follower.

In a further embodiment of any of the foregoing embodiments of the present disclosure, each of the followers supports an insert through a dovetail interface.

In a further embodiment of any of the foregoing embodiments of the present disclosure, each insert is engageable with one of the multiple of graduation sets.

In a further embodiment of any of the foregoing embodiments of the present disclosure, each of the multiple of graduation sets includes a radially inner graduation and a radially outer graduation. Each insert is engageable with either of the radially inner graduation and the radially outer graduation in response to rotation of the sync ring.

An active clearance control system of a gas turbine engine, according to another disclosed non-limiting embodiment of the present disclosure, includes a sync ring with a multiple of graduation sets. Each of the graduation sets includes a multiple of graduations to define an associated radial position for each of a respective multiple of blade outer air seal assemblies.

In a further embodiment of any of the foregoing embodiments of the present disclosure, each of the respective multiple of blade outer air seal assemblies includes an insert engaged with the sync ring.

In a further embodiment of any of the foregoing embodiments of the present disclosure, the sync ring is rotatable with respect to the multiple of blade outer air seal assemblies.

In a further embodiment of any of the foregoing embodiments of the present disclosure, the sync ring is a split ring.

In a further embodiment of any of the foregoing embodiments of the present disclosure, the multiple of graduation sets repeat along an outer surface of the sync ring.

A method of active blade tip clearance control for a gas turbine engine, according to another disclosed non-limiting embodiment of the present disclosure, includes selectively rotating a sync ring with a multiple of graduation sets to control an associated radial position for each of a respective multiple of blade outer air seal assemblies.

In a further embodiment of any of the foregoing embodiments of the present disclosure, the method includes selecting an insert for each of the multiple of blade outer air seal assemblies to zero out a tolerance within each of the multiple of blade outer air seal assemblies.

In a further embodiment of any of the foregoing embodiments of the present disclosure, the method includes biasing each of the multiple of blade outer air seal assemblies.

In a further embodiment of any of the foregoing embodiments of the present disclosure, the method includes biasing the sync ring to provide a fail-safe position for each of the multiple of blade outer air seal assemblies.

In a further embodiment of any of the foregoing embodiments of the present disclosure, the method includes selectively rotating the sync ring for a distance equivalent to each of the multiple of graduation sets.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
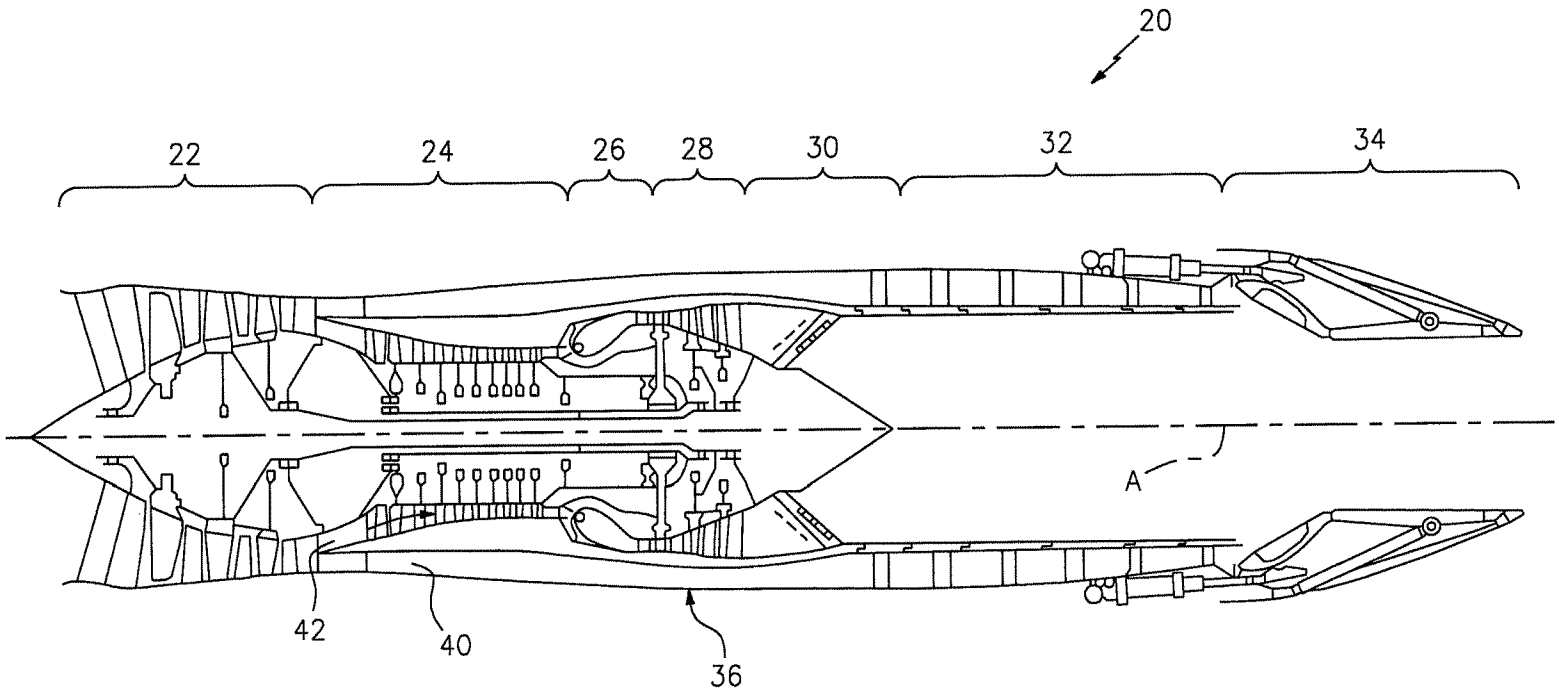
FIG. 1 is a schematic cross-section of one example aero gas turbine engine.

FIG. 1 schematically illustrates a gas turbine engine 20. The gas turbine engine 20 is disclosed herein as a two-spool low-bypass augmented turbofan that generally incorporates a fan section 22, a compressor section 24, a combustor section 26, a turbine section 28, an augmenter section 30, an exhaust duct section 32, and a nozzle system 34 along a central longitudinal engine axis A. Although depicted as an augmented low bypass turbofan in the disclosed non-limiting embodiment, it should be understood that the concepts described herein are applicable to other gas turbine engines including non-augmented engines, geared architecture engines, direct drive turbofans, turbojet, turboshaft, multi-stream variable cycle adaptive engines and other engine architectures. Variable cycle gas turbine engines power aircraft over a range of operating conditions and essentially alters a bypass ratio during flight to achieve countervailing objectives such as high specific thrust for high-energy maneuvers yet optimizes fuel efficiency for cruise and loiter operational modes.

An engine case structure 36 defines a generally annular secondary airflow path 40 around a core airflow path 42. Various static structures and modules may define the engine case structure 36 that essentially defines an exoskeleton to support the rotational hardware.

Air that enters the fan section 22 is divided between a core airflow through the core airflow path 42 and a secondary airflow through a secondary airflow path 40. The core airflow passes through the combustor section 26, the turbine section 28, then the augmentor section 30 where fuel may be selectively injected and burned to generate additional thrust through the nozzle system 34. It should be appreciated that additional airflow streams such as third stream airflow typical of variable cycle engine architectures may additionally be sourced from the fan section 22.

The secondary airflow may be utilized for a multiple of purposes that include, for example, cooling and pressurization. The secondary airflow as defined herein may be any airflow different from the core airflow. The secondary airflow may ultimately be at least partially injected into the core airflow path 42 adjacent to the exhaust duct section 32 and the nozzle system 34.

The exhaust duct section 32 may be circular in cross-section as typical of an axisymmetric augmented low bypass turbofan or may be non-axisymmetric in cross-section to include, but not be limited to, a serpentine shape to block direct view to the turbine section 28. In addition to the various cross-sections and the various longitudinal shapes, the exhaust duct section 32 may terminate in a Convergent/Divergent (C/D) nozzle system, a non-axisymmetric two-dimensional (2D) C/D vectorable nozzle system, a flattened slot nozzle of high aspect ratio or other nozzle arrangement.

Figure 2:
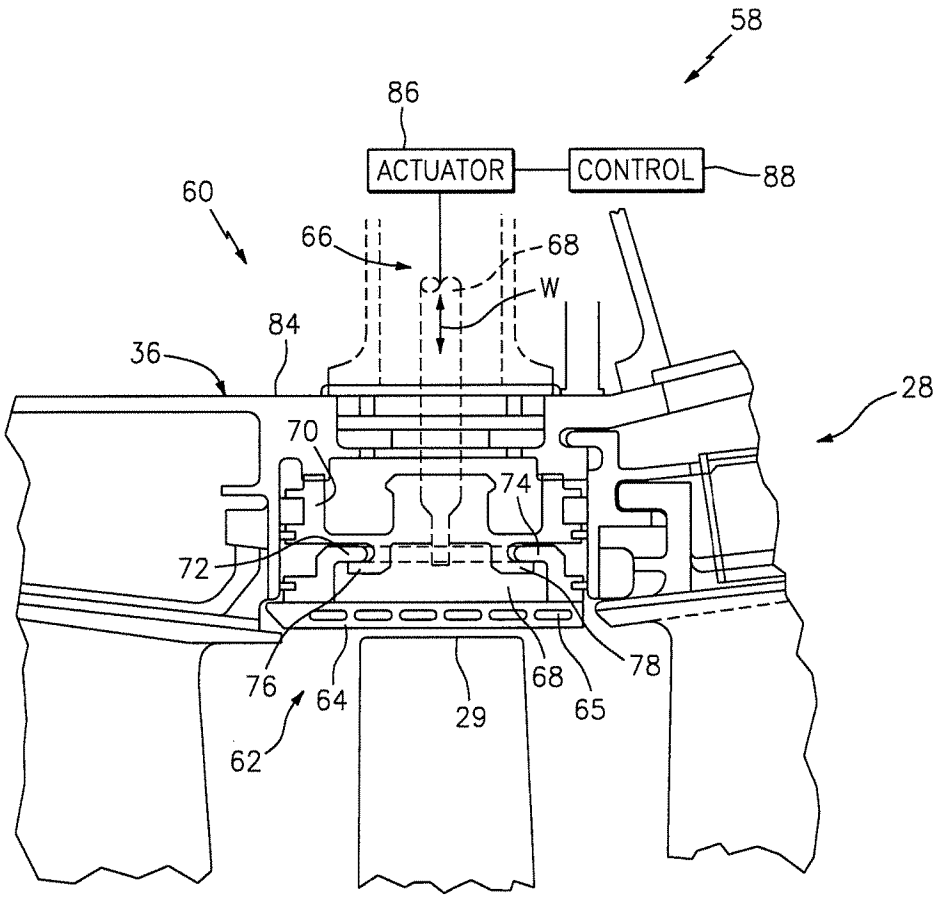
FIG. 2 is an enlarged partial sectional schematic view of a portion of a rapid response active clearance control system (RRACC) according to one disclosed non-limiting embodiment.

With reference to FIG. 2, a blade tip rapid response active clearance control (RRACC) system 58 includes a radially-adjustable Blade Outer Air Seal (BOAS) System 60 that operates to control blade tip clearances inside for example, the turbine section 28; however, other sections such as the compressor section 24 may also benefit herefrom. The radially-adjustable BOAS System 60 may be arranged around each or particular stage(s) within the gas turbine engine 20. That is, each rotor stage may have an independent radially-adjustable BOAS system 60 of the RRACC system 58.

Each BOAS System 60 is subdivided into a multiple of circumferential BOAS assemblies 62. Each BOAS assembly 62 includes a respective BOAS 64, a follower rod 68 and a BOAS carrier segment 70. Each BOAS 64 may be manufactured of an abradable material to accommodate potential interaction with the rotating blade tips 29 and may include numerous cooling air passages 65 to permit secondary airflow therethrough. In one disclosed non-limiting embodiment, each BOAS assembly 62 may extend circumferentially for about nine (9) degrees. It should be appreciated that any number of circumferential BOAS assemblies 62 and various other components may alternatively or additionally be provided.

The BOAS carrier segment 70 that is mounted to, or farms a portion of, the engine case structure 36 may at least partially independently support each of the multiple of BOASs 64. That is, each BOAS carrier segment 70 may have a guide feature that interfaces with the case structure 36 to minimize or prevent tipping. It should be appreciated that various static structures and guide features may additionally or alternatively be provided to at least partially support each BOAS assembly 62 yet permit relative radial movement thereof.

A radially extending forward hook 72 and an aft hook 74 of each BOAS 64 respectively cooperates with a forward hook 76 and an aft hook 78 of the full-hoop BOAS carrier segment 70. The forward hook 76 and the aft hook 78 of the BOAS carrier segment 70 may be segmented or otherwise configured for assembly of the respective BOAS 64 thereto. The forward hook 72 may extend axially aft and the aft hook 74 may extend axially forward (shown); vice-versa, or both may extend axially forward or aft within the engine to engage the reciprocally directed forward hook 76 and aft hook 78 of the BOAS carrier segment 70.

With continued reference to FIG. 2, the follower rod 68 radially positions each BOAS assembly 62. The follower rod 68 need only "pull" each associated BOAS 64 either directly or through the respective BOAS carrier segment 70 as a differential pressure between the core airflow and the secondary airflow biases the BOAS 64 toward the extended position. For example, the differential pressure may exert an about 1000 pound (4448 newtons) inward force on each BOAS 64.

The follower rod 68 from each associated BOAS 64 may extend from, or be a portion of, an actuator system 86 (illustrated schematically) that operates in response to a control 88 (illustrated schematically) to adjust the BOAS system 60. It should be appreciated that various other components such as sensors, seals and other components may be additionally utilized herewith.

The control 88 generally includes a control module that executes radial tip clearance control logic to thereby control the radial tip clearance relative the rotating blade tips 29. The control module typically includes a processor, a memory, and an interface. The processor may be any type of microprocessor having desired performance characteristics. The memory may be any computer readable medium which stores data and control algorithms such as the logic described herein. The interface facilitates communication with other components and systems. In one example, the control module may be a portion of a flight control computer, a portion of a Full Authority Digital Engine Control (FADEC), a stand-alone unit or other system.

Figure 3:
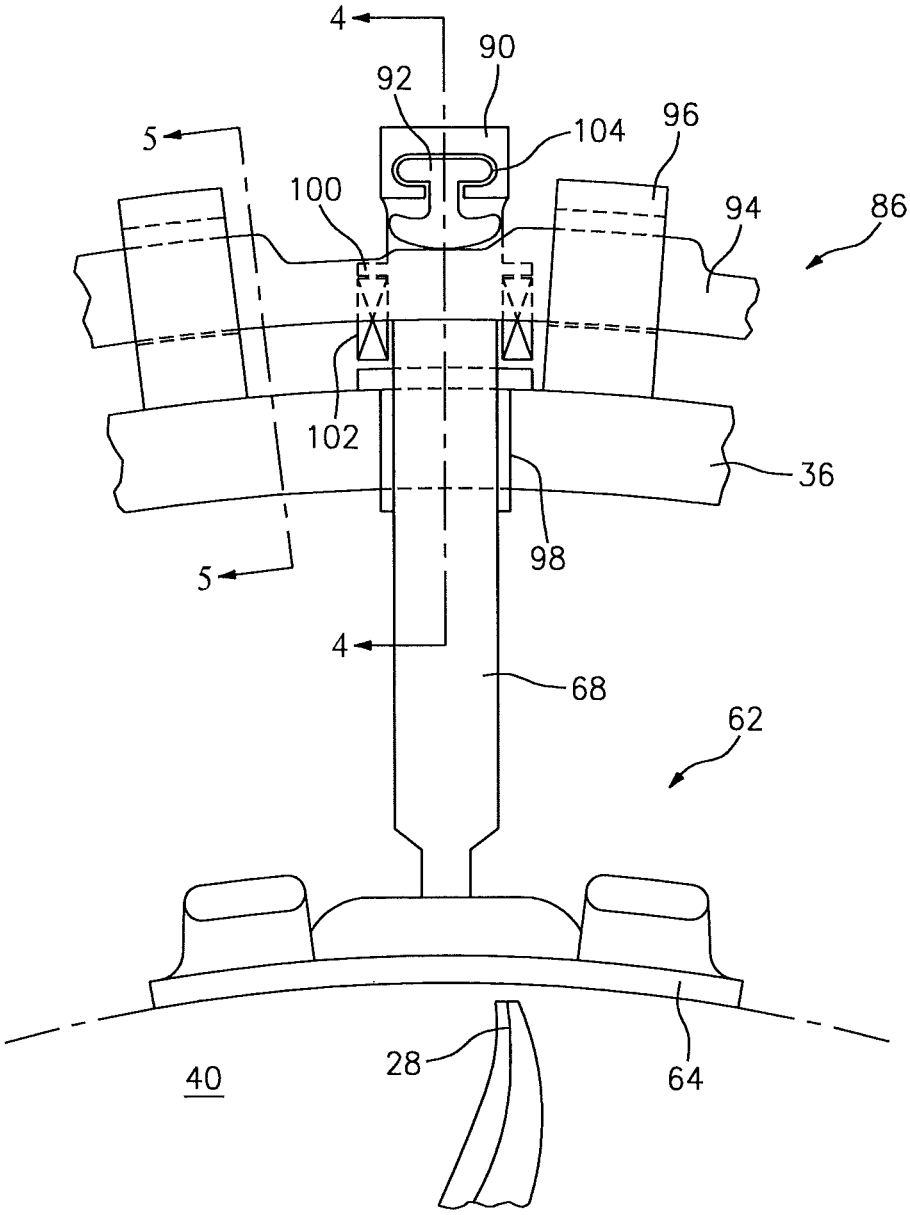
FIG. 3 is a lateral sectional view of the RRACC system.

With reference to FIG. 3, the actuator system 86 generally includes a follower 90 that extends transversely from each follower rod 68, an insert 92, a sync ring 94, and a multiple of sync ring guides 96. It should be appreciated that additional or alternative components may be provided and that although a single circumferential BOAS assembly 62 is described and illustrated in detail, each BOAS 64 is moved by one associated assembly 62 around the sync ring 94.

Each follower rod 68 extends through a bushing 98 in the engine case structure 36. The follower rod 68 may include a shoulder 100 that traps a bias member 102 such as a spring between the bushing 98 and the shoulder 100 (also shown in FIG. 4). The bias member 102 provides a radially outward bias to the follower rod 68 when the RRACC system 58 is idle such as when the engine 20 is shut down. That is, the bias member 102 maintains tautness within the RRACC system 58 so as to avoid potential contact with the blade tips 29 of the rotatable hardware when the engine 20 is shutdown.

Figure 4:
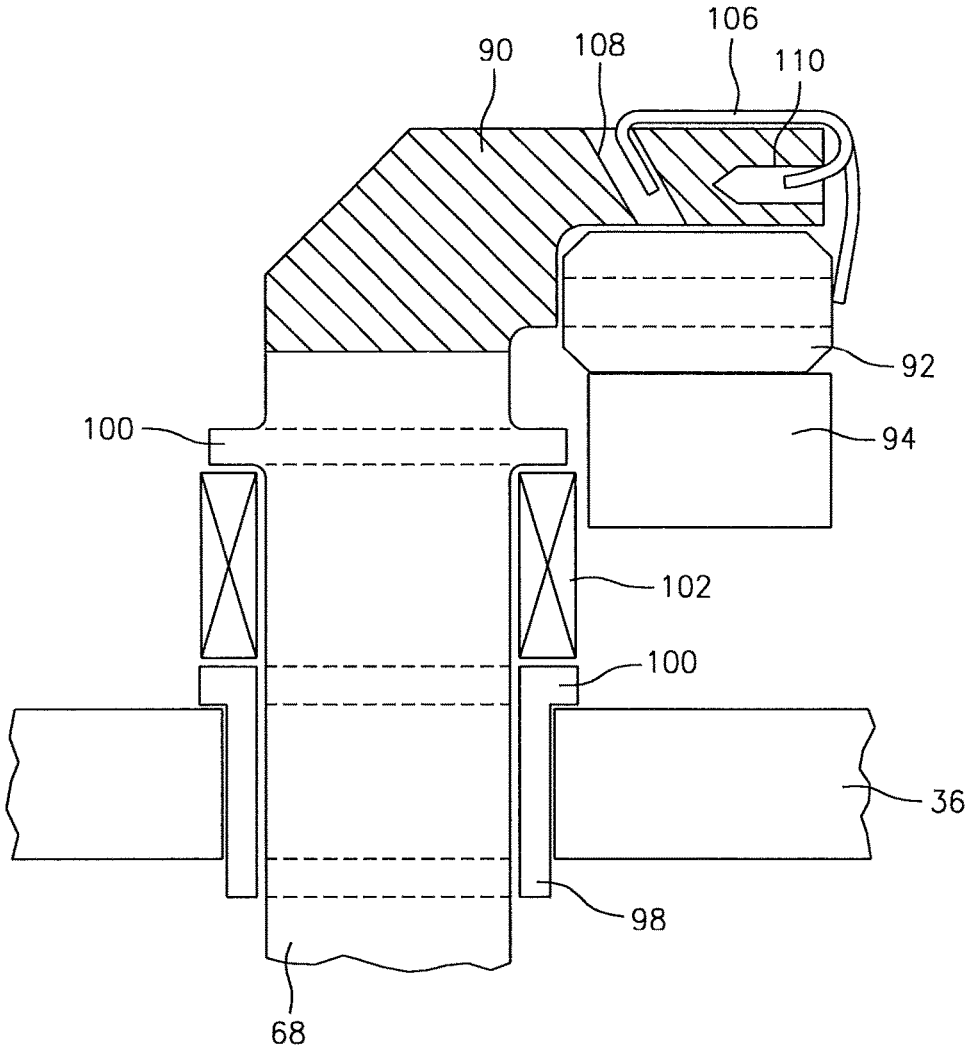
FIG. 4 is a longitudinal sectional view of the RRACC system.

The follower 90 extends axially from each respective radially arranged follower rod 68 and supports the insert 92 that rides upon the sync ring 94 (FIG. 4). That is, the follower 90 is transverse to the follower rod 68. The follower 90 and the insert 92 in this disclosed non-limiting embodiment define a dovetail interface 104 therebetween to facilitate replacement of the insert 92. The insert 92 provides effective radial and tangential load transmission from the sync ring 94 to the follower 90 and permits the insert 92 to be manufactured of a material different than the follower 90. In one example, the insert 92 may be manufactured of a high cobalt material to facilitate wear resistance. The insert 92 may also, for example, be retained with a clip 106 engageable with a first slot 108 and a second slot 110 in the follower 90 (see FIG. 4).

The radial position of each BOAS assembly 62 may differ from one BOAS 64 location to the next, as well as from one engine assembly to the next, due to, for example, the stack-up tolerance of the numerous components and interfaces. The insert 92 thereby provides a single component replacement to optimize the radial position of each BOAS 64. That is, the insert may be specifically selected to adjust each circumferential BOAS assembly 62 to, for example, zero out specific tolerances in each BOAS assembly 62. In other words, one BOAS assembly 62 may include a relatively thick insert 92 while another BOAS assembly 62 may include a relatively thin insert 92 to accommodate different tolerances in each. Such adjustability through inset 92 replacement permits the usage of individually ground BOASs 64 to minimize—if not eliminate—the heretofore requirement of an assembly grind. The individually ground BOASs 64 are also typically interchangeable one for another which simplifies engine maintenance.

The process of adjusting the radial position of each BOAS 64 at engine assembly may include, for example, a fixture that locates on the case 36 and provides an engine-concentric cylindrical surface inboard of the BOAS system 60; a single compression ring to push all followers 90 radially inboard into the sync ring 94; measurement of the gap/clearance between each BOASs 64 and the fixture; or direct measurement of the insert 92 used at each BOAS location for replacement of an insert 92 with a measured radial thickness that achieves the optimal radial position of each BOASs 64. It should be appreciated that other processes may also be utilized.

Figure 5:
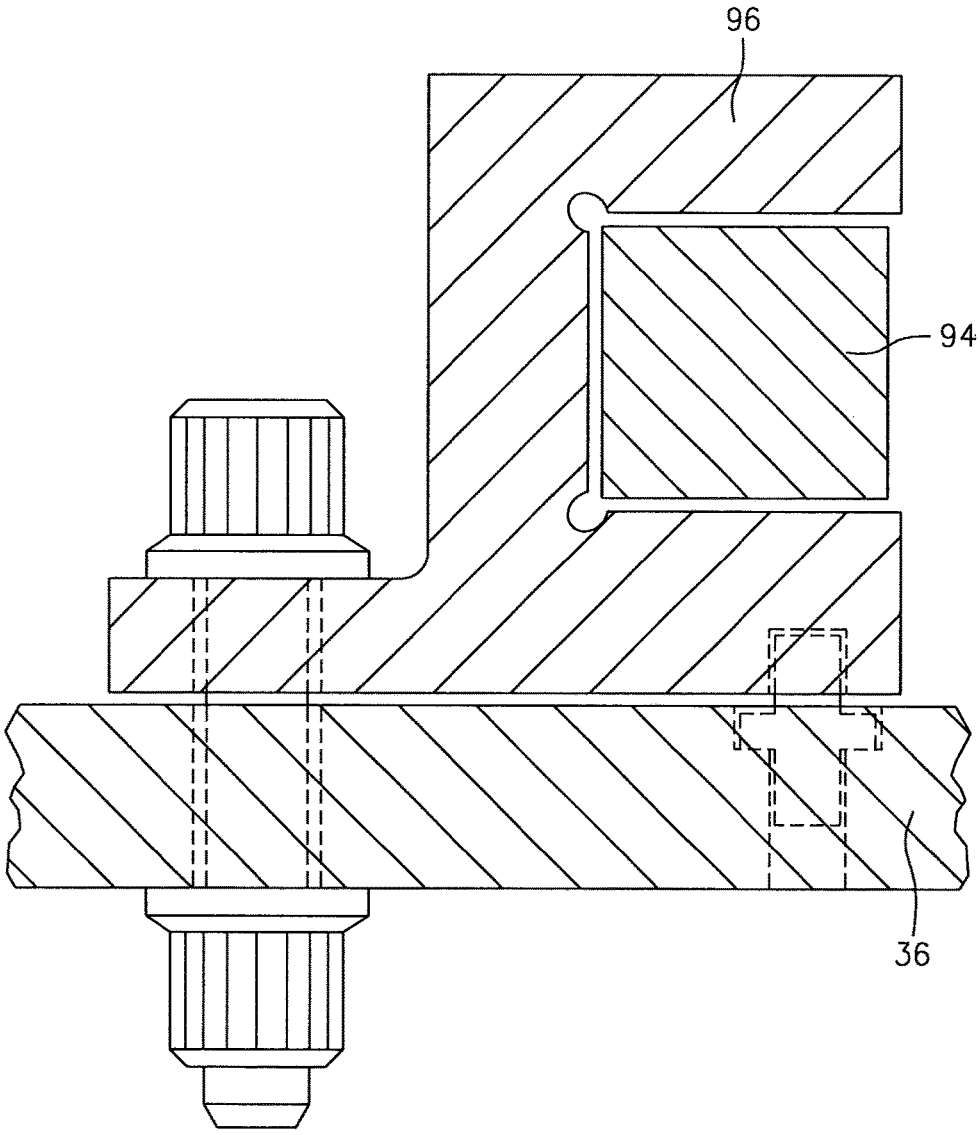
FIG. 5 is a longitudinal sectional view of a sync ring retainer.

The sync ring 94 is axially captured by the multiple of sync ring guides 96 (also shown in FIG. 5) and/or the followers 90. The sync ring guides 96 and/or the followers 90 may be axially opposed in the forward/aft directions to further axially capture and retain the sync ring 94.

Figure 6:
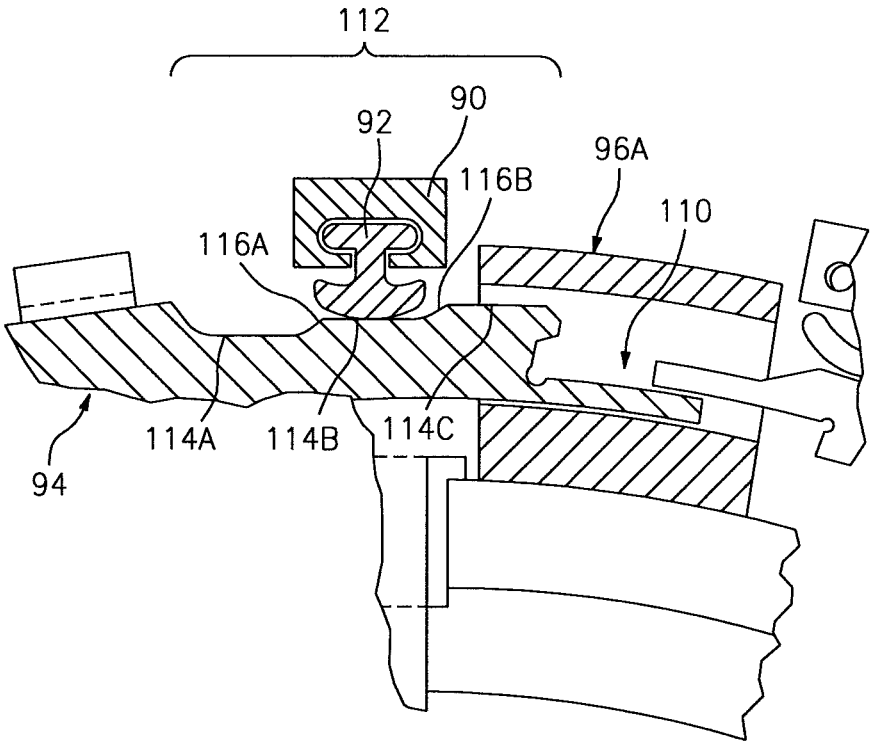
FIG. 6 is lateral sectional view of the sync ring according to one disclosed non-limiting embodiment.

With reference to FIG. 6, a single split 110 in the sync ring 94 is sized to accommodate thermal growth and contraction to maintain inner periphery contact with the sync ring guides 96. That is, the sync ring 94 is split at one location, loaded radially inboard by the insert 92 of each follower 90, which, in turn, loads the sync ring 94 radially inboard against the sync ring guides 96. The split 110 may also be located adjacent to an extended sync ring guide 96A.

The sync ring 94 further includes a multiple of graduation sets 112. Each of the multiple of graduation sets 112 are associated with one insert 92 of each respective BOAS assembly 62. In one disclosed non-limiting embodiment, each graduation set 112 includes a multiple of graduations 114A, 114B, 114C (three shown). Although three graduations 114A, 114B, 114C are illustrated in the disclosed non-limiting embodiment, any number of graduations will benefit herefrom.

Each graduation 114A, 114B, 114C defines an associated radial position for one insert 90 and thereby the respective BOAS 64 of each BOAS assembly 62. Each graduation 114A, 114B, 114C is a generally radially constant surface separated by a respective ramp 116A, 116B. In this example, graduation 114A is radially inward of graduation 114B which is radially inward of graduation 114C. That is, graduation 114A defines a radially innermost position for the respective BOAS 64, graduation 114C defines a radially outermost position for the respective BOAS 64 while graduation 114B defines an intermediate position. The graduation 114A may be used for a partial power operational condition;

graduation114B may be used for a cruise power operational condition; and graduation 114C may be used for a snap transient operational condition e.g., military-idle-military-power. Again, any number of graduations for various operational conditions may be defined.

Figure 7:
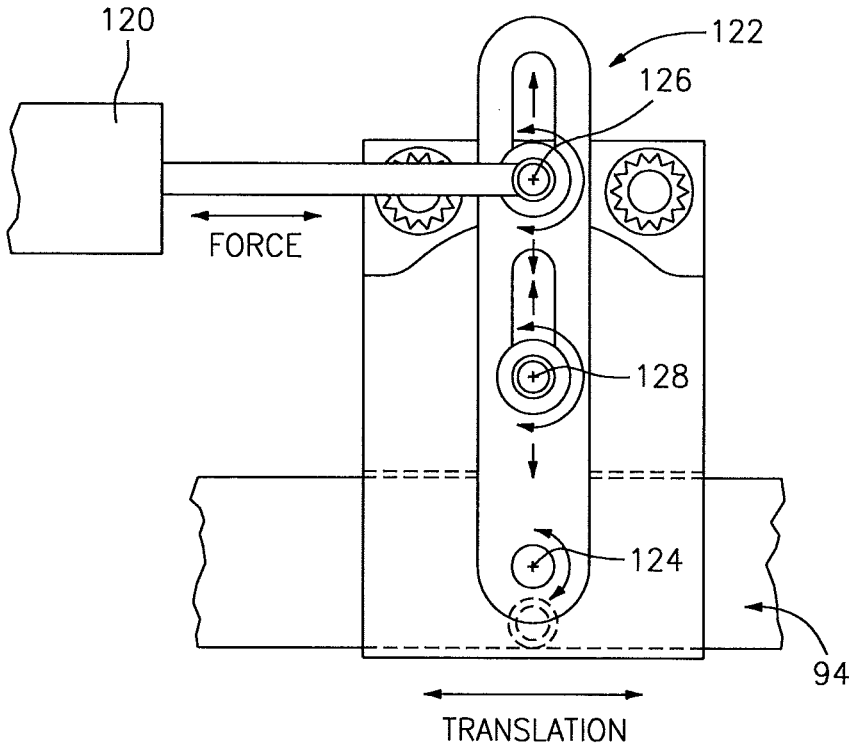
FIG. 7 is schematic view of an actuator linkage for the sync ring.

With reference to FIG. 7, at least one actuator 120 such as a mechanical, hydraulic, electrical and/or pneumatic drive to rotate the sync ring 94 through a linkage 122. Radial loads on the BOAS 64 cause each respective insert 92 to be loaded against the sync ring 94 such that as the sync ring 94 is rotated, the follower 90, and thus the BOAS 64, are radially positioned. That is, the actuator 120 provides the motive force to rotate the sync ring 94 and thereby contract and expand the radially-adjustable BOAS system 60.

The linkage 122 generally includes a pivot interface 124 at the sync ring 94, a slotted actuator interface 126 from the actuator 120 and a slotted intermediate interface 128 therebetween. Although the slotted actuator interface 126 and the slotted intermediate interface 128 are illustrated in the disclosed non-limiting embodiment, it should be appreciated that any two of the three may be slotted to provide the desired degrees of freedom.

The pivot interface 124 may be located opposite (e.g., 180 degrees from) the split 110 (see FIG. 8) in the sync ring 94 to minimize the maximum relative circumferential growth between the sync ring 94 and any single follower 90 and to minimize the length of sync ring 94 that is pushed by the actuator 120. In this disclosed non-limiting embodiment, the actuator 120 actuates the linkage 122 to pull the sync ring 94 in a rotational direction from graduation 114A toward graduation 114C. Further, the linkage 122 may be biased toward graduation 114C via a load from a spring or other bias system to provide a fail-safe outward position for the BOAS system 60 should the actuator 120 be unavailable.

The RRACC system 58 enables turbine blade tip clearance to be reduced significantly at cruise as well as other engine conditions through precise radial positioning of each BOAS 64 at assembly and enables rapid variable radial adjustment of the BOAS system 60 during operation/flight. The position of each individual BOAS 64 is readily independently adjusted by fitting of a specific insert 92 to compensate for non-symmetrical, out-of-round, and sinusoidal rub patterns demonstrated during engine development to provide an efficiency improvement relative to simple off-set/non-concentric grind and assembly grind methods. The individual adjustability provided by the insert 92 further enables tighter control of BOAS substrate and/or coating rub depth, substrate and/or coating thickness to, for example, provide improved BOAS durability life and/or improved turbine performance with reduced cooling flow. The insert 92 further enables peak tip clearance performance to be restored in the field regardless of how many/few BOAS 64 are replaced for reasons such as erosion. This achieves greater performance than what is typically achievable with an assembly grind and lowers maintenance cost.

The use of the terms "a" and "an" and "the" and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to the normal operational attitude of the vehicle and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

The foregoing description is exemplary rather than defined by the features within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed is:

1. An active clearance control system of a gas turbine engine, the system comprising:

a multiple of blade outer air seal assemblies; and a sync ring with a multiple of graduation sets, each of the graduation sets associated with one of the multiple of blade outer air seal assemblies;

wherein each of the multiple of blade outer air seal assemblies includes a blade outer air seal and a follower rod that extends therefrom;

wherein each of the multiple of follower rods terminates in a follower transverse to the follower rod; and wherein each of the followers supports an insert.

2. The system as recited in claim 1, wherein each of the multiple of graduation sets includes a radially inner graduation and a radially outer graduation.

3. The system as recited in claim 2, further comprising an intermediate graduation radially between the radially inner graduation and the radially outer graduation.

4. The system as recited in claim 1, wherein each insert is manufactured of a material different than the follower.

5. The system as recited in claim 1, wherein each of the followers supports an insert through a dovetail interface.

6. The system as recited in claim 1, wherein each insert is engageable with one of the multiple of graduation sets.

7. The system as recited in claim 1, wherein each of the multiple of graduation sets includes a radially inner graduation and a radially outer graduation, and each insert is engageable with either of the radially inner graduation and the radially outer graduation in response to rotation of the sync ring.

8. The system as recited in claim 1, wherein the sync ring is rotatable with respect to the multiple of blade outer air seal assemblies.

9. The system as recited in claim 1, wherein the sync ring is a split ring.

10. The system as recited in claim 1, wherein the multiple of graduation sets repeat along an outer surface of the sync ring.

* * * * *